US010711499B2

(12) United States Patent
Walz

(10) Patent No.: US 10,711,499 B2
(45) Date of Patent: Jul. 14, 2020

(54) SOFT CLOSING DAMPER FITTING FOR A SLIDING DOOR AND ASSOCIATED MOUNTING METHOD

(71) Applicant: Häfele GmbH & Co KG, Nagold (DE)

(72) Inventor: Rüdiger Walz, Neustetten (DE)

(73) Assignee: HÄFELE GMBH & CO KG, Nagold (DE)

( * ) Notice: Subject to any disclaimer, the term of this patent is extended or adjusted under 35 U.S.C. 154(b) by 282 days.

(21) Appl. No.: 15/890,348

(22) Filed: Feb. 7, 2018

(65) Prior Publication Data

US 2018/0223579 A1 Aug. 9, 2018

(30) Foreign Application Priority Data

Feb. 7, 2017 (DE) ..... 20 2017 100 625 U

(51) Int. Cl.

*E05F 5/00* (2017.01)
*E05F 5/02* (2006.01)
*E05F 1/16* (2006.01)

(52) U.S. Cl.

CPC ..... *E05F 5/003* (2013.01); *E05F 1/16* (2013.01); *E05F 5/027* (2013.01); *E05Y 2400/82* (2013.01); *E05Y 2600/46* (2013.01); *E05Y 2600/51* (2013.01); *E05Y 2600/626* (2013.01); *E05Y 2800/174* (2013.01)

(58) Field of Classification Search

CPC .. E05F 5/003; E05F 5/027; E05F 1/16; E05Y 2600/626; E05Y 2800/174; E05D 11/0009
See application file for complete search history.

(56) References Cited

U.S. PATENT DOCUMENTS 3,188,682 A * 6/1965 Check ..... E05F 3/227 16/49
4,086,681 A * 5/1978 Nakanishi ..... E05F 3/00 16/49
4,831,687 A * 5/1989 Lin ..... E05F 3/00 16/49
4,847,946 A * 7/1989 Nam ..... E05F 3/102 16/53
6,032,330 A * 3/2000 Chen ..... E05F 3/22 16/49

(Continued)

FOREIGN PATENT DOCUMENTS

DE 20315124 U1 2/2004

*Primary Examiner* — Jeffrey O'Brien
(74) *Attorney, Agent, or Firm* — Hackler Daghighian Martino & Novak

(57) ABSTRACT

A soft closing damper fitting includes a soft closing damper fastenable to an internal door leaf of a multi-leaf sliding door and can be used for right-hand or left-hand closing. A Z-shaped profiled sheet has a central leg and with two outer legs angled in each case by 90° in opposing directions. For fastening the soft closing damper for right-hand closing the central leg comprises first fastening holes and a first marking for its fastening position on the internal door leaf. For fastening the soft closing damper for left-hand closing the central leg comprises second fastening holes and a second marking for its fastening position on the internal door leaf. The first fastening holes are spaced apart from the second fastening holes and the first marking is spaced apart from the second marking in each case by the same distance A in the longitudinal direction of the profile.

20 Claims, 4 Drawing Sheets

(56) References Cited

U.S. PATENT DOCUMENTS

| | | | | |
|---|---|---|---|---|
| 6,374,505 | B2 * | 4/2002 | Myers | E05F 3/00 33/194 |
| 6,430,834 | B2 * | 8/2002 | Myers | E05F 3/00 33/194 |
| 7,698,796 | B1 * | 4/2010 | Dowling | E05F 3/22 29/402.08 |
| 8,756,759 | B2 * | 6/2014 | Kaestle | E05F 3/22 16/49 |
| 9,435,152 | B2 * | 9/2016 | Zimmer | E05F 1/16 |
| 2004/0098940 | A1 * | 5/2004 | Latessa | E04F 21/003 52/514 |
| 2018/0016832 | A1 * | 1/2018 | Rodriguez | E05D 15/06 |
| 2018/0186029 | A1 * | 7/2018 | Bowerman | B27F 5/12 |

* cited by examiner

SOFT CLOSING DAMPER FITTING FOR A SLIDING DOOR AND ASSOCIATED MOUNTING METHOD

CROSS-REFERENCE TO RELATED APPLICATIONS

This patent application claims priority to the German utility model application number 20 2017 100 625.5 filed on Feb. 7, 2017, the entire contents of which are fully incorporated herein with these references.

DESCRIPTION

Field of the Invention

The invention relates to a soft closing damper fitting comprising a soft closing damper which is fastenable to an internal door leaf of a multi-leaf sliding door and which is able to be used for right-hand or left-hand closing by laterally reversed fastening to the internal door leaf, and a sliding door having at least two door leaves which are slidable in two parallel planes in two directions and which at the same time overlap one another, and having a soft closing damper fitting for the soft closing of the two door leaves into their end position overlapping one another and also a method for mounting the soft closing damper fitting on a sliding door.

Background of the Invention

Such soft closing damper fittings for sliding doors are generally known and comprise on the one door leaf a soft closing damper with a follower displaceably guided between a retracted end position and a tilted release position and on the other door leaf an activator cooperating with the follower.

SUMMARY OF THE INVENTION

In order to simplify the mounting of such a soft closing damper fitting on the sliding door, according to the invention it is provided that the soft closing damper fitting, as a mounting aid for fastening the soft closing damper to the internal door leaf, comprises a Z-shaped profiled sheet with a central leg and with two outer legs angled in each case by 90° in opposing directions, and that for fastening the soft closing damper for right-hand closing the central leg comprises first fastening holes and a first marking for its fastening position on the internal door leaf and for fastening the soft closing damper for left-hand closing the central leg comprises second fastening holes and a second marking for its fastening position on the internal door leaf, wherein the first fastening holes are spaced apart from the second fastening holes and the first marking is spaced apart from the second marking in each case by the same distance in the longitudinal direction of the profile.

Preferably, the markings in each case are configured as a transverse slot and/or as a longitudinal scale in the central leg and/or in the outer legs. Alternatively, the marking may also be formed by a nose, notch, etc. in the Z-shaped profiled sheet. Using a door marking on the internal door leaf, the Z-shaped profiled sheet with its marking may be easily adjusted for a desired spacing for finger protection between the gripping strips of the two door leaves in the overlapping end position. Advantageously, the longitudinal scale is assigned to a longitudinal slot extending in the Z-shaped profiled sheet in order to be able to identify the door marking inside the longitudinal slot.

The distance depends on the spacing of the retracted follower from the middle of the soft closing damper and the position of the door marking on the internal door leaf and is generally selected such that the desired finger protection spacing is produced. Preferably, the distance A is at least 20 mm.

Particularly preferably, the soft closing damper fitting comprises an activator which is fastenable to a front door leaf of the sliding door and which cooperates with the soft closing damper. The activator may be formed, for example, by an angled free end of an activator bracket or by a height-adjustable screw of an activator bracket. Preferably, the activator bracket also has a marking, in particular a slot, for its fastening position on the front door leaf.

The invention further relates to a sliding door comprising at least two door leaves which are slidable in two parallel planes in two directions and which at the same time overlap one another, and comprising a soft closing damper fitting which is configured as above for the soft closing of the two door leaves into their end position overlapping one another, wherein the Z-shaped profiled sheet rests with the upper of its two outer legs on the upper edge of the internal door leaf and by means of its first or second marking is aligned with a door marking of the internal door leaf and wherein the soft closing damper is fastened by means of the first or second fastening holes of the Z-shaped profiled sheet to the rear face of the internal door leaf.

The door marking is preferably located in the middle of the internal door leaf and may be formed by a vertical line on the rear face of the internal door leaf and/or by a transverse line on the upper edge of the internal door leaf.

Preferably, the activator bracket is aligned by means of its marking with a door marking of the front door leaf and is fastened to the rear face of the front door leaf. The door marking may be formed by a vertical line on the rear face of the front door leaf and/or by a transverse line on the upper edge of the front door leaf.

In the case of a triple-leaf sliding door with two internal door leaves and a front door leaf, according to the invention the soft closing damper of the one internal door leaf is oriented for right-hand closing and the soft closing damper of the other internal door leaf is oriented for left-hand closing, wherein the activator of the front door leaf in each case cooperates with the soft closing dampers of the two internal door leaves.

The invention finally also relates to a method for mounting a soft closing damper fitting which is configured as above on a sliding door with at least two door leaves which are slidable in two parallel planes in two directions and which at the same time overlap one another, comprising the following mounting steps:

attaching an, in particular, central door marking to the one internal door leaf;

aligning the Z-shaped profiled sheet using its first or second marking with the door marking of the internal door leaf and fastening the soft closing damper by means of the aligned Z-shaped profiled sheet to the rear face of the internal door leaf;

attaching an, in particular, central door marking to the other front door leaf; and aligning the activator bracket using its marking with the door marking of the front door leaf and fastening the activator bracket to the rear face of the front door leaf.

Further advantages of the invention are disclosed from the description, the claims and the drawings. Similarly, the features mentioned above and specified below may be used individually or in any combinations. The embodiments which are shown and described are not to be understood as a conclusive list, but are of an exemplary nature for describing the invention.

DETAILED DESCRIPTION OF THE PREFERRED EMBODIMENTS

Figure 1A:
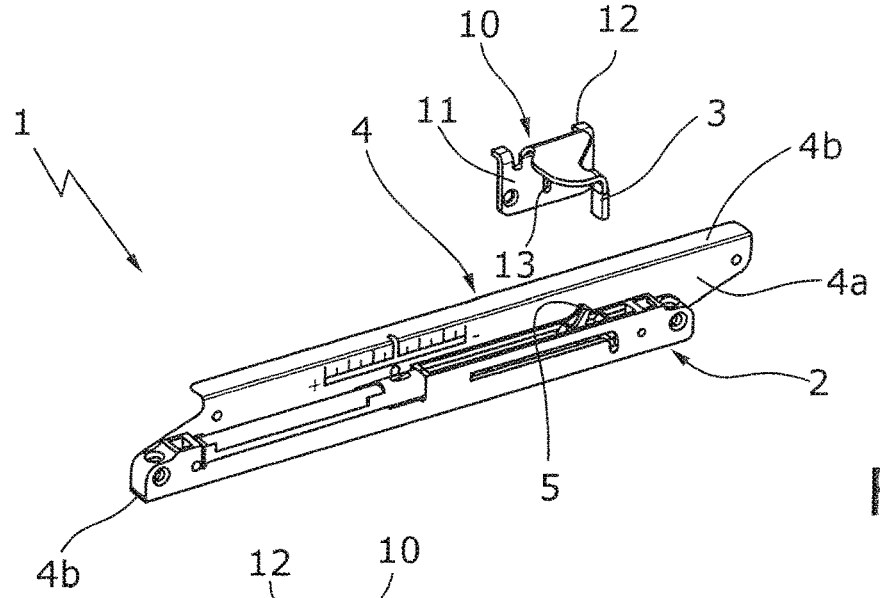
FIGS. 1*a*, 1*b* show a soft closing damper fitting according to the invention with a soft closing damper oriented for left-hand closing (FIG. 1*a*) or right-hand closing (FIG. 1*b*) and with an activator.

In the following description of the figures, identical reference numerals are used for components which are the same and/or functionally the same.

Figure 1B:
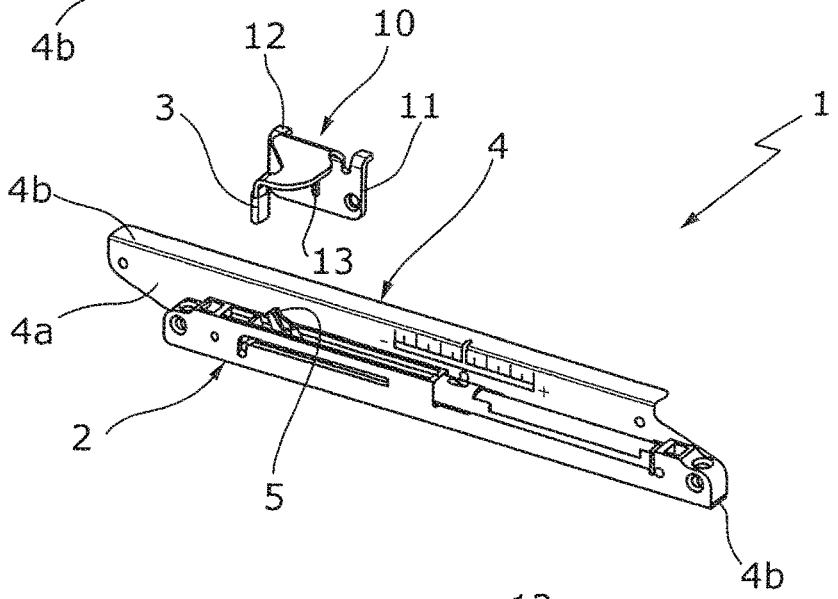
Figure 2:
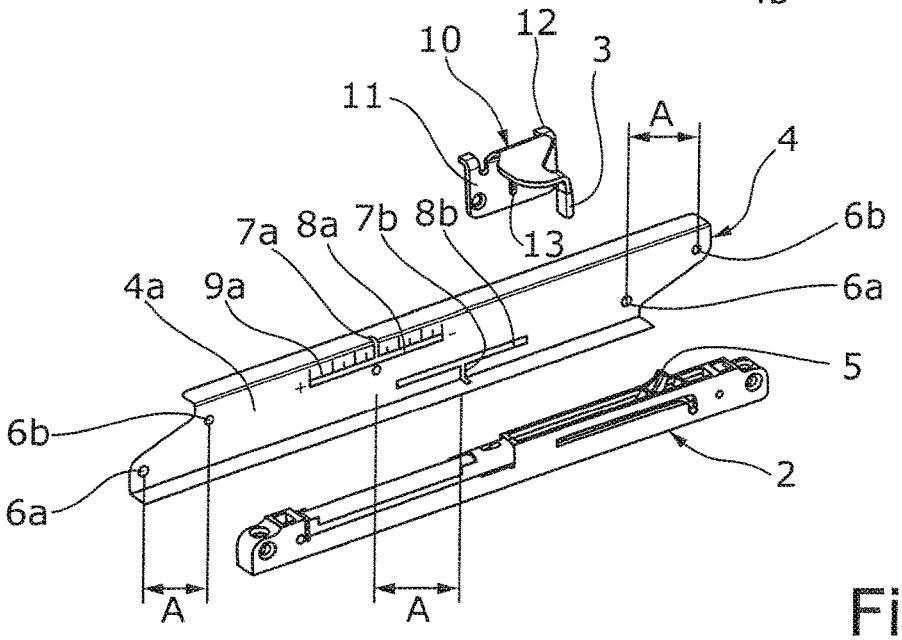
FIG. 2 shows the individual components of the soft closing damper fitting shown in FIG. 1.

The soft closing damper fitting 1 shown in FIGS. 1 and 2 serves for the soft closing of two door leaves 21, 22, which are slidable in two parallel planes in two directions and which at the same time overlap one another, of a double-leaf sliding door 20 (FIGS. 3 and 4) into their end position overlapping one another. The two door leaves 21, 22 are preferably of the same width.

The soft closing damper fitting 1 comprises a soft closing damper 2 (for example an oil damper) which is fastenable to the one internal door leaf 21 for the soft closing of the two door leaves 21, 22 into their overlapping end position, an activator 3 which is fastenable to the other front door leaf 22 and cooperates with the soft closing damper 2, and as a mounting aid for fastening the soft closing damper 2 to the internal door leaf 21, a Z-shaped profiled sheet 4 with a central leg 4*a* for abutting flat against the rear face of the internal door leaf 22 and with two outer legs 4*b* angled in each case by 90° in opposing directions. The soft closing damper 2 has in the known manner a follower 5 which cooperates with the activator 3 and which is displaceably guided between a retracted end position and a tilted released position shown in each case in FIGS. 1*a*, 1*b*, and may be used for closing to the left (FIG. 1*a*) or to the right (FIG. 1*b*) by a laterally reversed arrangement.

For fastening the soft closing damper 2 for left-hand closing, the central leg 4*a* of the Z-shaped profiled sheet 4 has first fastening holes 6*a* and a first marking 7*a* for its fastening position on the internal door leaf 21 and, for fastening the soft closing damper 2 for right-hand closing, said central leg has second fastening holes 6*b* and a second marking 7*b* for its fastening position on the internal door leaf 21. The first fastening holes 6*a* are spaced apart from the second fastening holes 6*b* and the first marking 7*a* is spaced apart from the second marking 7*b* in each case by the same distance A in the longitudinal direction of the profile. In this case, the first fastening holes 6*a* are located in the one half of the central leg 4*a* and the second fastening holes 6*b* are arranged in the other half of the central leg, and namely such that the first fastening holes 6*a* are arranged for the abutment of the soft closing damper 2 to the one outer leg 4*b* and the second fastening holes 6*b* are arranged for the abutment of the soft closing damper 2 on the other outer leg 4*b*. The central leg 4*a* is configured in the shape of a parallelogram, and the two outer legs 4*b* are offset relative to one another by the distance A in the longitudinal direction of the profile. For reasons of the finger protection described in more detail below, the distance A is at least 15 mm. The markings in each case are configured as a continuous transverse slot 7*a*, 7*b* extending in the central leg 4*a* and in one of the outer legs 5*b*, said transverse slot in turn intersecting a longitudinal slot 8*a*, 8*b* extending in the central leg 4*a*. In each case, a longitudinal scale 9*a*, 9*b* in centimetres is assigned to the longitudinal slots 8*a*, 8*b*, which indicates the respective (+/−) spacing from the point of intersection ("0" point) of the transverse and longitudinal slots 7*a*, 8*a* and/or 7*b*, 8*b*. Instead of the slot marking shown, the Z-shaped profiled sheet 4 may also have a nose or notch as the marking.

An activator bracket 10 made of sheet metal has a fastening leg 11 for fastening to the rear face of the front door leaf 22 and a free end which is angled to the front on the fastening leg 11 by 180° and which forms the activator 3. At the top, two tabs 12 are angled to the rear by 90° on the fastening leg 11. Moreover, the fastening leg 11 is provided with a marking 13 designed as a vertical slot for its fastening position on the front door leaf 12.

The mounting of the soft closing damper fitting 1 on a sliding door 20 with two door leaves 21, 22 which are slidable in two parallel planes in two directions and which at the same time overlap one another is described hereinafter.

Figure 3A:
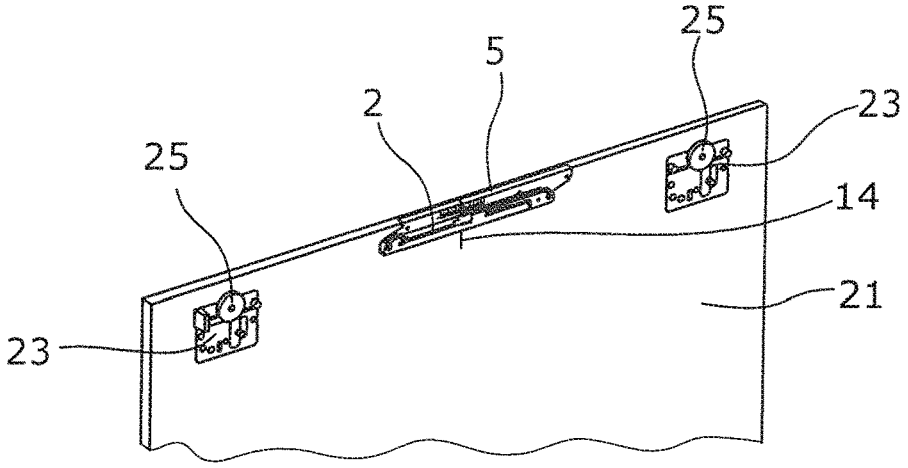
FIGS. 3*a*, 3*b* show an internal door leaf of a sliding door with the soft closing damper (FIG. 3*a*) fastened thereto and a front door leaf of the sliding door with the activator fastening thereto (FIG. 3*b*)

As shown in FIG. 3*a* a door marking 14 in the form of a vertical line is attached centrally to the rear face of the internal door leaf 21. The Z-shaped profiled sheet 4 is oriented for right-hand or left-hand closing and placed with its upper outer leg 4*b* onto the upper edge of the internal door leaf 21. Subsequently, the Z-shaped profiled sheet 4 using its upper marking, i.e. in the present case using its transverse slot 7*a* or its scale 9*a*, is aligned with this door marking 14 in the longitudinal direction of the profile and the soft closing damper 2 which is placed on the lower outer leg 4*b* is screwed by means of the aligned Z-shaped profiled sheet 4 to the rear face of the internal door leaf 21, by fastening screws (not shown) being inserted through holes in the soft closing damper 2 and through the fastening holes 6*a* or 6*b* and being screwed into the internal door leaf 21.

Figure 3B:
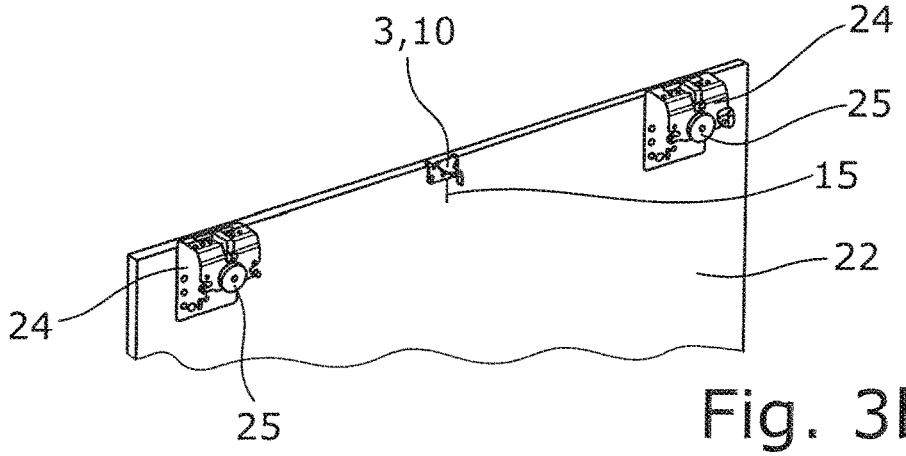

As shown in FIG. 3*b* a door marking 15 in the form of a vertical line is attached centrally to the rear face of the front door leaf 22. The activator bracket 10 is placed with its two tabs 12 onto the upper edge of the front door leaf 22, using its marking, i.e. in the present case using its slot 13, aligned with this door marking 15 in the longitudinal direction of the profile and screwed to the rear face of the front door leaf 22.

As shown further in FIGS. 3*a*, 3*b*, each door leaf 21, 22 has two running parts 23 and/or 24 having one respective running roller 25.

Figure 4:
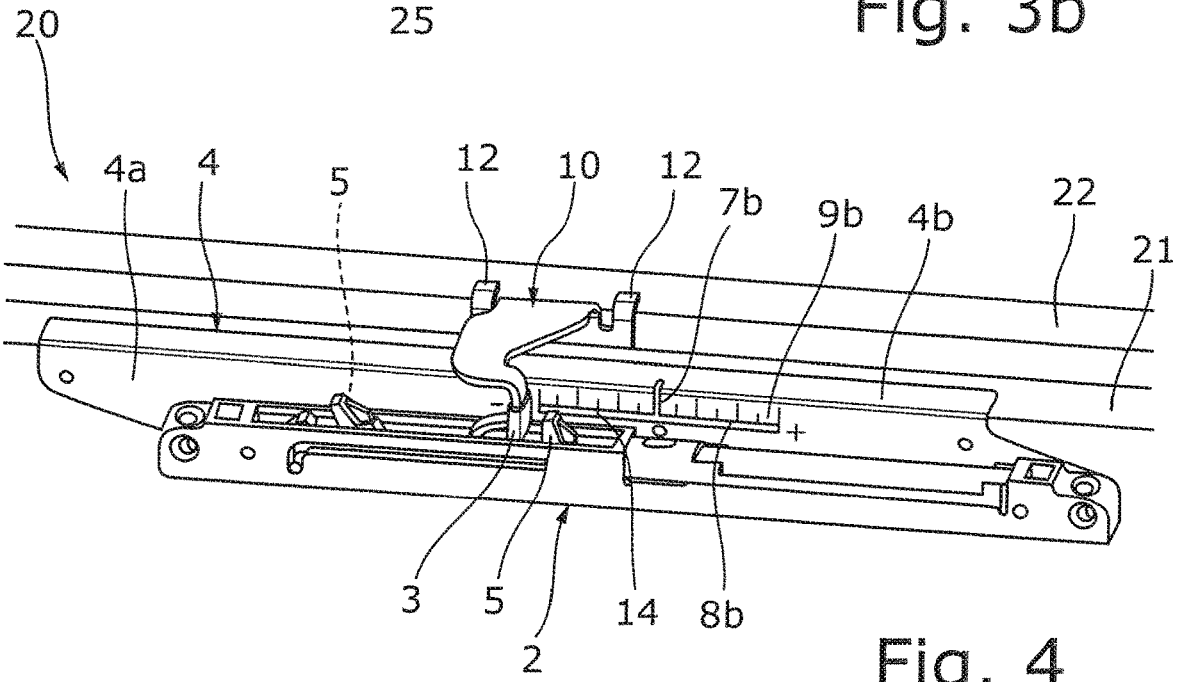
FIG. 4 shows the soft closing damper fitting mounted on the sliding door in the overlapping end position of the two door leaves in a perspective rear view of the sliding door.

FIG. 4 shows the soft closing damper fitting 1 mounted on the sliding door 20 as right-hand closing, in the overlapping end position of the two door leaves 21, 22 in which the follower 5 has been retracted by a closing spring counter to the action of a damper from its tilted release position (indicated in dashed lines) into its end position shown in a solid line, and at the same time has entrained the activator 3 together with the front door leaf 22. More specifically, the follower 5 is entrained by the activator 3 out of a retracted first end position, counter to the action of a closing spring (not shown) as far as the second end position ("park position") releasing the activator 3, in which the follower 5 is tilted and thereby locked. By means of the released activator 3, the follower 5 is released from the second end position and then together with the activator 3 retracted into the first end position.

Figure 5A:
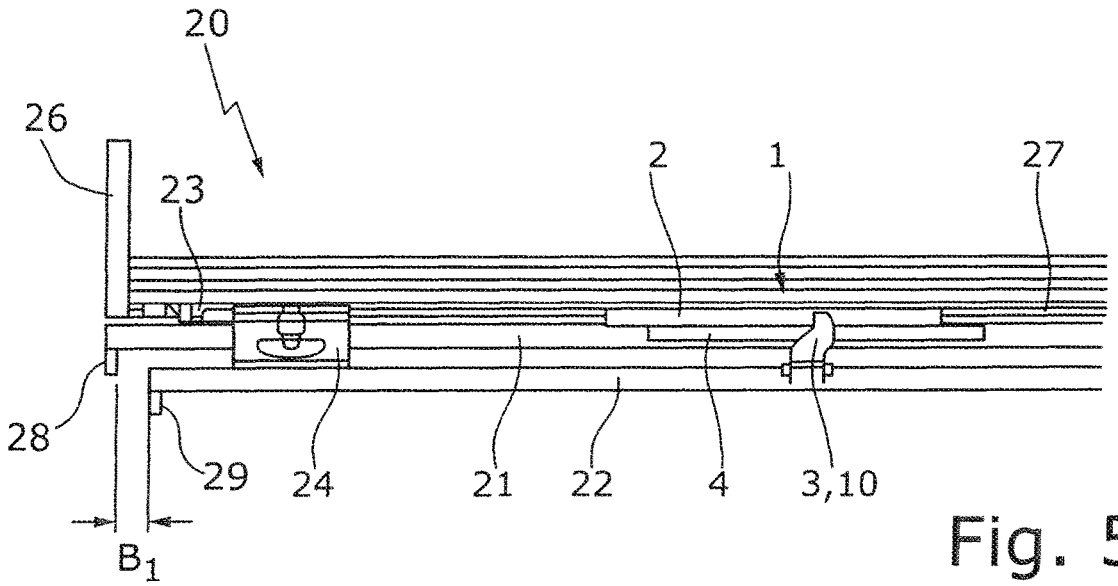
FIGS. 5*a*, 5*b* show a plan view from above of the two door leaves of the sliding door in the overlapping end position of the two door leaves with a finger protection spacing adjusted to be wide (FIG. 5*a*) and adjusted to be narrow (FIG. 5*b*)
Figure 5B:
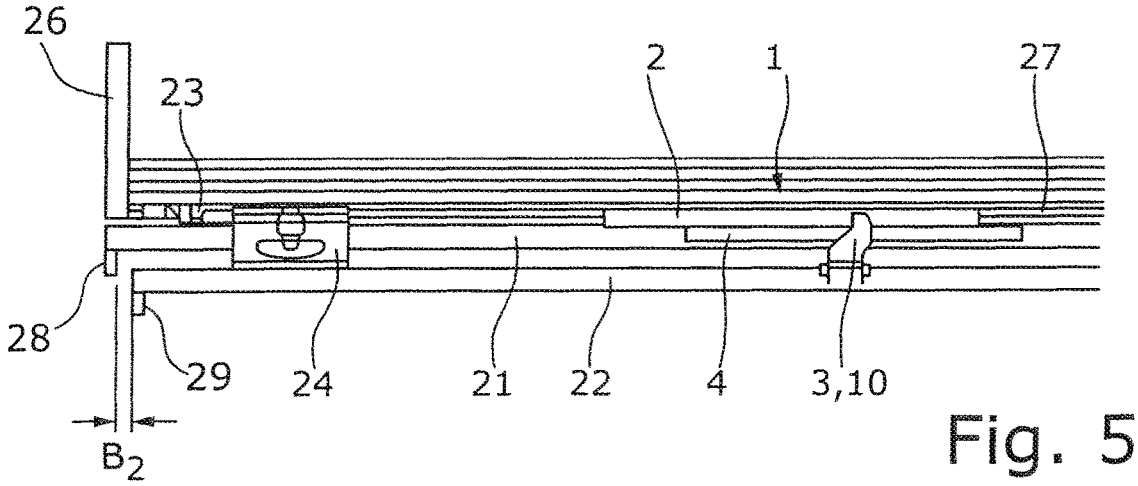

A double-track running rail 27 is fastened at the top of the door frame and/or (cupboard) body 26 (FIGS. 5*a*, 5*b*), the internal door leaf 21 being suspended by means of its two running parts 23 in the front rail track of said running rail, and the front door leaf 22 being suspended by means of its two running parts 24 in the rear rail track of said running rail and in each case being displaceably guided between a closed and an open end position. The running parts 24 of the front door leaf 22 encompass the internal door leaf 21 together with its running parts 23 in the manner of a clamp such that when the door leaves 21, 22 are displaced the running parts 23, 24 do not mutually hinder one another and only abut against one another in the overlapping end position, and are prevented from travelling further over one another. The overlapping end position is thus defined by the mutual abutment of the running parts 23, 24. The two door leaves 21, 22 are shown in their overlapping end position, and namely in FIG. 5*a* in the case of a finger protection spacing $B_1$ which is adjusted to be wide, and in FIG. 5*b* in the case of a finger protection spacing $B_2$ which is adjusted to be narrow, between the left-hand gripping strips 28, 29 of the two door leaves 21, 22. The finger protection spacing prevents a finger from being able to become trapped between the gripping strips 28, 29 in the overlapping end position. The desired finger protection spacing may be adjusted, for example, using the longitudinal scale 9*a*, 9*b* via an arrangement of the Z-shaped profiled sheet 4 on the internal door leaf 21 which is offset relative to the door marking 14, and should be at least 2 cm. In FIG. 4, the Z-shaped profiled sheet 4 is arranged offset relative to the door marking 14 by −1.5 cm from the zero position which corresponds to a finger protection spacing of 2 cm.

Figure 6:
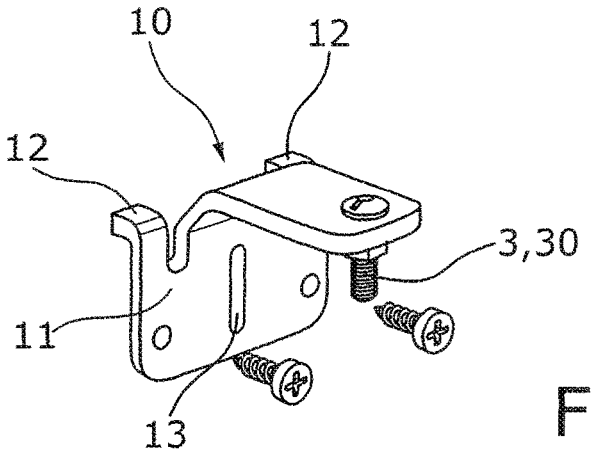
FIG. 6 shows a modified height-adjustable activator of the soft closing damper fitting according to the invention.

FIG. 6 shows a modified height-adjustable activator 3 which is formed by a height-adjustable screw 30 of the activator bracket 10.

Figure 7A:
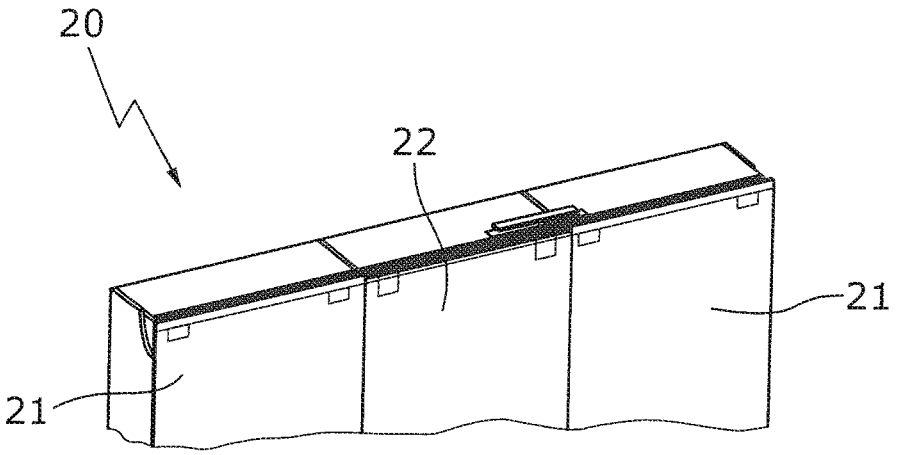
FIGS. 7*a*-7*c* show the perspective front view of a triple-leaf sliding door with a front central door leaf and two internal door leaves, wherein in FIG. 7*a* all three door leaves are closed and in FIGS. 7*b*, 7*c* the front door leaf and the left-hand inner door leaf are displaced relative to one another into an overlapping end position.
Figure 7B:
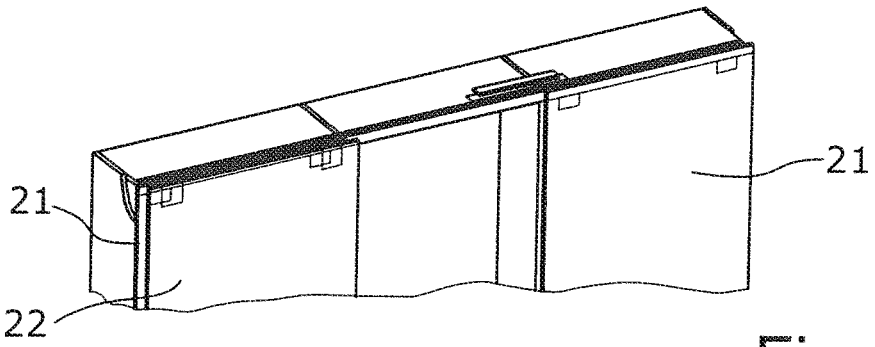
Figure 7C:
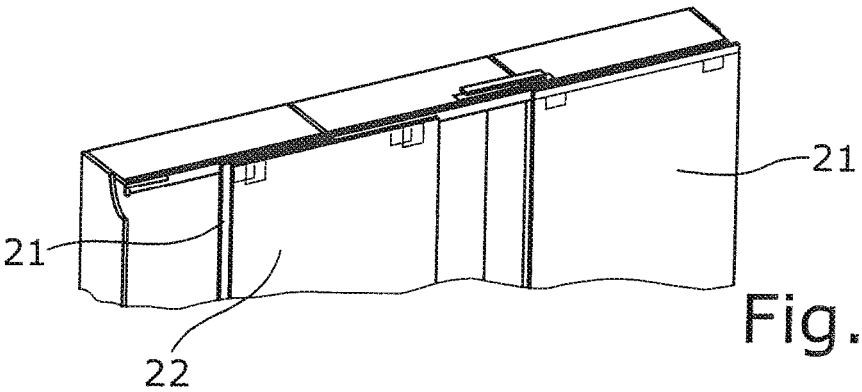

The triple leaf sliding door 20, shown FIGS. 7*a*-7*c*, comprises two internal door leaves 21 and a front door leaf 22, wherein the soft closing damper 2 of the one internal door leaf 21 is oriented for right-hand closing and the soft closing damper 2 of the other internal door leaf 21 is oriented for left-hand closing, and wherein the activator 3 of the front door leaf 22 cooperates with the soft closing dampers 2 of the two internal door leaves 21. In FIG. 7*a*, all three door leaves 21, 22 are closed, in FIG. 7*b* the front door leaf 22 has been slid over the closed left-hand internal door leaf 22 and in FIG. 7*c* the front door leaf has been slid over the partially open left-hand internal door leaf 22, in each case into the overlapping end position.

What is claimed is:

1. A soft closing damper fitting, comprising:

a soft closing damper fastenable to an internal door leaf of a multi-leaf sliding door and which is able to be used for right-hand or left-hand closing by laterally reversed fastening to the internal door leaf;

wherein the soft closing damper fitting, as a mounting aid for fastening the soft closing damper to the internal door leaf, comprises a Z-shaped profiled sheet with a central leg, a first outer leg, and a second outer leg angled in each case by 90° in opposing directions; and wherein for fastening the soft closing damper for right-hand closing the central leg comprises first fastening holes and a first marking for a first fastening position on the internal door leaf and for fastening the soft closing damper for left-hand closing the central leg comprises second fastening holes and a second marking for a second fastening position on the internal door leaf;

wherein the first marking is spaced apart from the second marking by a distance A in the longitudinal direction of the Z-shaped profiled sheet and wherein each of the first fastening holes have corresponding second fastening holes, wherein the first fastening holes are spaced apart from the corresponding second fastening holes by the distance A in the longitudinal direction.

2. The soft closing damper fitting according to claim 1, wherein the first and second markings are each configured as a transverse slot in at least one of the central leg and the outer legs.

3. The soft closing damper fitting according to claim 1, wherein the first fastening holes are arranged in a first half of the central leg and the second fastening holes are arranged in a second half of the central leg.

4. The soft closing damper fitting according to claim 1, wherein the first fastening holes are arranged for abutment of the soft closing damper to the first outer leg and the second fastening holes are arranged for abutment of the soft closing damper to the second outer leg.

5. The soft closing damper fitting according to claim 1, wherein the first and second markings are configured as a longitudinal scale in at least one of the central leg and in the outer legs.

6. The soft closing damper fitting according to claim 5, wherein the longitudinal scale is assigned to a longitudinal slot extending in the Z-shaped profiled sheet.

7. The soft closing damper fitting according to claim 1, wherein the central leg is configured in the shape of a parallelogram and the two outer legs are offset relative to one another by the distance A in the longitudinal direction of the Z-shaped profiled sheet.

8. The soft closing damper fitting according to claim 1, wherein the distance A is at least 20 mm.

9. The soft closing damper fitting according to claim 1, including an activator fastenable to an external door leaf of the sliding door and which cooperates with the soft closing damper.

10. The soft closing damper fitting according to claim 9, wherein the activator is formed by an angled free end of an activator bracket.

11. The soft closing damper fitting according to claim 10, wherein the activator bracket has a third marking comprising a slot for a fastening position on the external door leaf.

12. The soft closing damper fitting according to claim 9, wherein the activator is formed by a height-adjustable screw of an activator bracket.

13. The soft closing damper fitting according to claim 12, wherein the activator bracket has a third marking comprising a slot for a fastening position on the external door leaf.

14. A sliding door, comprising:

at least an internal door leaf having a rear face and an upper edge and an external door leaf having a rear face and an upper edge which two door leaves are slidable in two parallel planes in two directions and which at the same time overlap one another; and a soft closing damper fitting for the soft closing of the two door leaves into their end position overlapping one another, the soft closing damper fitting comprising:

a soft closing damper fastened to the internal door leaf and which is able to be used for right-hand or left-hand closing by laterally reversed fastening to the internal door leaf;

wherein the soft closing damper fitting, as a mounting aid for fastening the soft closing damper to the internal door leaf, comprises a Z-shaped profiled sheet with a central leg and with two outer legs angled in each case by 90° in opposing directions; and wherein for fastening the soft closing damper for right-hand closing the central leg comprises first fastening holes and a first marking for a first fastening position on the internal door leaf and for fastening the soft closing damper for left-hand closing the central leg comprises second fastening holes and a second marking for a second fastening position on the internal door leaf;

wherein the first marking is spaced apart from the second marking by a distance A in the longitudinal direction of the Z-shaped profiled sheet and wherein each of the first fastening holes have corresponding second fastening holes, wherein each of the first fastening holes are spaced apart from the corresponding second fastening holes by the distance A in the longitudinal direction;

wherein one of the two outer legs of the Z-shaped profiled sheet rests on the upper edge of the internal door leaf and the first or second marking of the Z-shaped profiled sheet is aligned with a door marking of the internal door leaf; and wherein the soft closing damper is fastened by means of the first or second fastening holes of the Z-shaped profiled sheet to the rear face of the internal door leaf.

15. The sliding door according to claim 14, wherein the door marking is located in a middle of the internal door leaf.

16. The sliding door according to claim 14, wherein the door marking is formed by at least one of a vertical line on the rear face of the internal door leaf and a transverse line on the upper edge of the internal door leaf.

17. The sliding door according to claim 14, including an activator fastenable to an external door leaf of the sliding door and which cooperates with the soft closing damper, wherein the activator is formed by an angled free end of an activator bracket or wherein the activator is formed by a height-adjustable screw of the activator bracket, wherein the activator bracket has a third marking comprising a slot for a fastening position on the external door leaf, wherein the third marking of the activator bracket is aligned with a door marking of the external door leaf and is fastened to the rear face of the external door leaf.

18. The sliding door according to claim 17, wherein the door marking of the external door leaf is formed by at least one of a vertical line on the rear face of the external door leaf and a transverse line on the upper edge of the external door leaf.

19. The sliding door according to claim 14, comprising at least two internal door leaves each having a soft closing damper, wherein the soft closing damper of the one internal door leaf is oriented for right-hand closing and the soft closing damper of the other internal door leaf is oriented for left-hand closing, and wherein an activator of the external door leaf cooperates with the soft closing dampers of the two internal door leaves.

20. A method for mounting a soft closing damper fitting on a sliding door with at least an internal door leaf having a rear face and an upper edge and with an external door leaf having a rear face and an upper edge which two door leaves are slidable in two parallel planes in two directions and which at the same time overlap one another, the soft closing damper fitting comprising:

a soft closing damper fastened to the internal door leaf and which is able to be used for right-hand or left-hand closing by laterally reversed fastening to the internal door leaf;

wherein the soft closing damper fitting, as a mounting aid for fastening the soft closing damper to the internal door leaf, comprises a Z-shaped profiled sheet with a central leg and with two outer legs angled in each case by 90° in opposing directions; and wherein for fastening the soft closing damper for right-hand closing the central leg comprises first fastening holes and a first marking for a first fastening position on the internal door leaf and for fastening the soft closing damper for left-hand closing the central leg comprises second fastening holes and a second marking for a second fastening position on the internal door leaf;

wherein the first marking is spaced apart from the second marking by a distance A in the longitudinal direction of the Z-shaped profiled sheet and wherein each of the first fastening holes have corresponding second fastening holes, wherein each of the first fastening holes are spaced apart from the corresponding second fastening holes by the distance A in the longitudinal direction;

the method for mounting the soft closing damper fitting comprising the steps of:

attaching a central door marking to the internal door leaf;

aligning the first or second marking of the Z-shaped profiled sheet with the door marking of the internal door leaf and fastening the soft closing damper by means of the aligned Z-shaped profiled sheet to the rear face of the internal door leaf;

attaching a central door marking to the external door leaf; and aligning a third marking of an activator bracket with the door marking of the external front door leaf and fastening the activator bracket to the rear face of the external door leaf.

* * * * *